US007034462B2

(12) United States Patent
Abiko et al.

(10) Patent No.: US 7,034,462 B2
(45) Date of Patent: Apr. 25, 2006

(54) POWER SUPPLY CIRCUIT FOR TRAVELING-WAVE TUBE WHICH ELIMINATES LARGE RELAY AND RELAY DRIVING POWER SUPPLY

(75) Inventors: Shuji Abiko, Kanagawa (JP); Eiji Fujiwara, Kanagawa (JP)

(73) Assignee: NEC Microwave Tube, Ltd., (JP)

( * ) Notice: Subject to any disclaimer, the term of this patent is extended or adjusted under 35 U.S.C. 154(b) by 19 days.

(21) Appl. No.: 10/936,662

(22) Filed: Sep. 9, 2004

(65) Prior Publication Data

US 2005/0057159 A1 Mar. 17, 2005

(30) Foreign Application Priority Data

Sep. 17, 2003 (JP) ..... 2003-324769

(51) Int. Cl.
*H01J 25/34* (2006.01)

(52) U.S. Cl. ..... 315/3.5; 315/3.6

(58) Field of Classification Search ..... 315/3.5, 315/3.6, 500, 5, 39, 39.3, 39.63, 46–49; 219/715–717, 219/723; 361/52–56
See application file for complete search history.

(56) References Cited

U.S. PATENT DOCUMENTS

| | | | | |
|---|---|---|---|---|
| 4,323,853 | A * | 4/1982 | Kurokawa | 315/3.6 |
| 5,500,621 | A * | 3/1996 | Katz et al. | 315/3.5 |
| 6,586,883 | B1 * | 7/2003 | Staub et al. | 315/3.5 |
| 6,777,876 | B1 * | 8/2004 | Kobayashi et al. | 315/3.5 |

FOREIGN PATENT DOCUMENTS

JP HEI 11-149880 6/1999

* cited by examiner

*Primary Examiner*—Wilson Lee
(74) *Attorney, Agent, or Firm*—Dickstein, Shapiro, Morin & Oshinsky, LLP.

(57) ABSTRACT

A power supply circuit for a traveling-wave tube disclosed herein eliminates a large relay and a relay driving power supply to reduce the size and cost and to make itself tolerable to vibrations and impacts. A first control device turns on, when a potential on a helix electrode rises to a predetermined threshold determined by the ratio of the resistance of a first resistor to the resistance of a second resistor with respect to a potential on a positive heater electrode or a negative heater electrode, to conduct from a first terminal to a second terminal of the first control device. A second control device turns on when the first control device is off to maintain an anode electrode and a cathode electrode at the same potential. The second control device turns off when the first control device turns on to generate a potential difference between the anode electrode and cathode electrode, thereby applying a voltage to the anode electrode.

12 Claims, 4 Drawing Sheets

POWER SUPPLY CIRCUIT FOR TRAVELING-WAVE TUBE WHICH ELIMINATES LARGE RELAY AND RELAY DRIVING POWER SUPPLY

BACKGROUND OF THE INVENTION

1. Field of the Invention

The present invention relates to a power supply circuit for powering a traveling-wave tube.

2. Description of the Related Art

A traveling-wave tube must be supplied with a variety of voltages such as a heater voltage, a cathode voltage, a helix voltage, and a collector voltage. In addition, the respective voltages are sequentially applied in accordance with a predetermined procedure called an "anode sequence" in order to prevent excessive currents. After a heater has been sufficiently heated by the heater voltage applied thereto (for example, in several minutes), the helix voltage is applied. Then, according to the anode sequence, the anode voltage is applied later than the helix voltage.

For powering a traveling-wave tube in accordance with an anode sequence as mentioned above, a circuit including a relay has been conventionally required, and power supply apparatuses for traveling-wave tubes have been used in a variety of configurations (for example, see JP-11-149880-A).

FIG. 1 is a block diagram illustrating an exemplary configuration of a conventional power supply apparatus for traveling-wave tube. Referring to FIG. 1, conventional power supply apparatus 90 for a traveling-wave tube comprises collector power supply 91, helix power supply 92, heater power supply 93, and anode power supply 94. Anode power supply 94 includes resistors 95, 98, control circuit 96, and relay 97.

One electrode is commonly used as a heater electrode and a cathode electrode on the positive side of traveling-wave tube 99, so that this electrode is hereinafter called the "heater/cathode electrode." Also, a heater electrode on the negative side of traveling-wave tube 99 is simply called the "heater electrode."

Heater power supply 93 supplies a heater voltage between the heater/cathode electrode and heater electrode of traveling-wave tube 99. Collector power supply 91 supplies a collector voltage between a collector electrode and the heater/cathode electrode of traveling-wave tube 99. Helix power supply 92 supplies a helix voltage between a helix electrode and the heater/cathode electrode of traveling-wave tube 99.

Anode power supply 94 comprises control circuit 96 and resistor 95 connected in series between the helix electrode and heater/cathode electrode of traveling-wave tube 99; resistor 98 connected between the anode electrode and heater/cathode electrode; and relay 97 through which a junction between control circuit 96 and resistor 95 is connected to the anode electrode. Anode power supply 94 generates an anode voltage based on the helix voltage, and supplies the anode voltage between the anode electrode and heater/cathode electrode of traveling-wave tube 99.

Control circuit 96 includes a series regulator (not shown) for decreasing and stabilizing the helix voltage, and for setting a voltage at the junction between control circuit 96 and resistor 95 to the anode voltage or a voltage equal to or lower than a maximum open/close voltage of relay 97.

In this way, the conventional power supply apparatus for a traveling-wave tube detects a rising and a falling edge of the helix voltage to control on/off of the anode voltage through predetermined processing. The conventional power supply apparatus for a traveling-wave tube relies on this control to apply the anode voltage later than the helix voltage in accordance with the anode sequence to prevent an excessive current from flowing into the traveling-wave tube through the helix electrode.

However, the foregoing conventional power supply apparatus implies the following problems.

Power supply apparatus 90 for a traveling-wave tube illustrated in FIG. 1 requires control circuit 96 for detecting the helix voltage and performing the predetermined processing, and also requires a relay driving power supply (not shown) for driving relay 97. Also, isolation must be provided by a vacuum relay or the like between control circuit 96 which operates at a lower voltage and relay 97 which operates at a higher voltage. Thus, the conventional power supply apparatus for a traveling-wave tube is disadvantageously increased in size and cost. Also, since relays are generally prone to destruction due to vibrations and impacts, the power supply apparatus for a traveling-wave tube is disadvantageously vulnerable to vibrations and impacts.

SUMMARY OF THE INVENTION

It is an object of the present invention to provide a small-size and low-cost circuit for powering a traveling-wave tube in a vibration and impact tolerable configuration.

To achieve the above object, a power supply circuit for a traveling-wave tube according to the present invention is provided for applying a voltage to an anode electrode of the traveling-wave tube which is applied with different voltages from a power supply apparatus to a helix electrode, a positive heater electrode, a negative heater electrode, and a cathode electrode. The power supply circuit includes a first resistor, a second resistor, a first control device, and a second control device.

The first and second resistors are connected in series between the helix electrode and positive heater electrode or negative heater electrode of the traveling-wave tube.

The first control device, which is made of semiconductor, has a first terminal, a second terminal, and a first control terminal. The first terminal is connected to the negative heater electrode, and the first control terminal is connected to a junction of the first resistor and the second resistor. Then, the first control device turns on when a potential on the helix electrode rises to a predetermined threshold determined by the ratio of the resistance of the first resistor to the resistance of the second resistor with respect to a potential on the positive heater electrode or negative heater electrode, to conduct from the first terminal to the second terminal.

The second control device, which is made of semiconductor, has a third terminal, a fourth terminal, and a second control terminal. The second control terminal is connected to the second terminal of the first control device; the third terminal to the anode electrode of the traveling-wave tube; and the fourth electrode to the positive heater electrode or negative heater electrode. Then, the second control device turns on when the first control device is off to maintain the anode electrode and cathode electrode at the same potential, and turns off when the first control device turns on to generate a potential difference between the anode electrode and cathode electrode, thereby applying a voltage to the anode electrode.

The above and other objects, features, and advantages of the present invention will become apparent from the following description with reference to the accompanying drawings which illustrate examples of the present invention.

EMBODIMENTS

One embodiment of the present invention will be described in detail with reference to the accompanying drawings.

Figure 1:
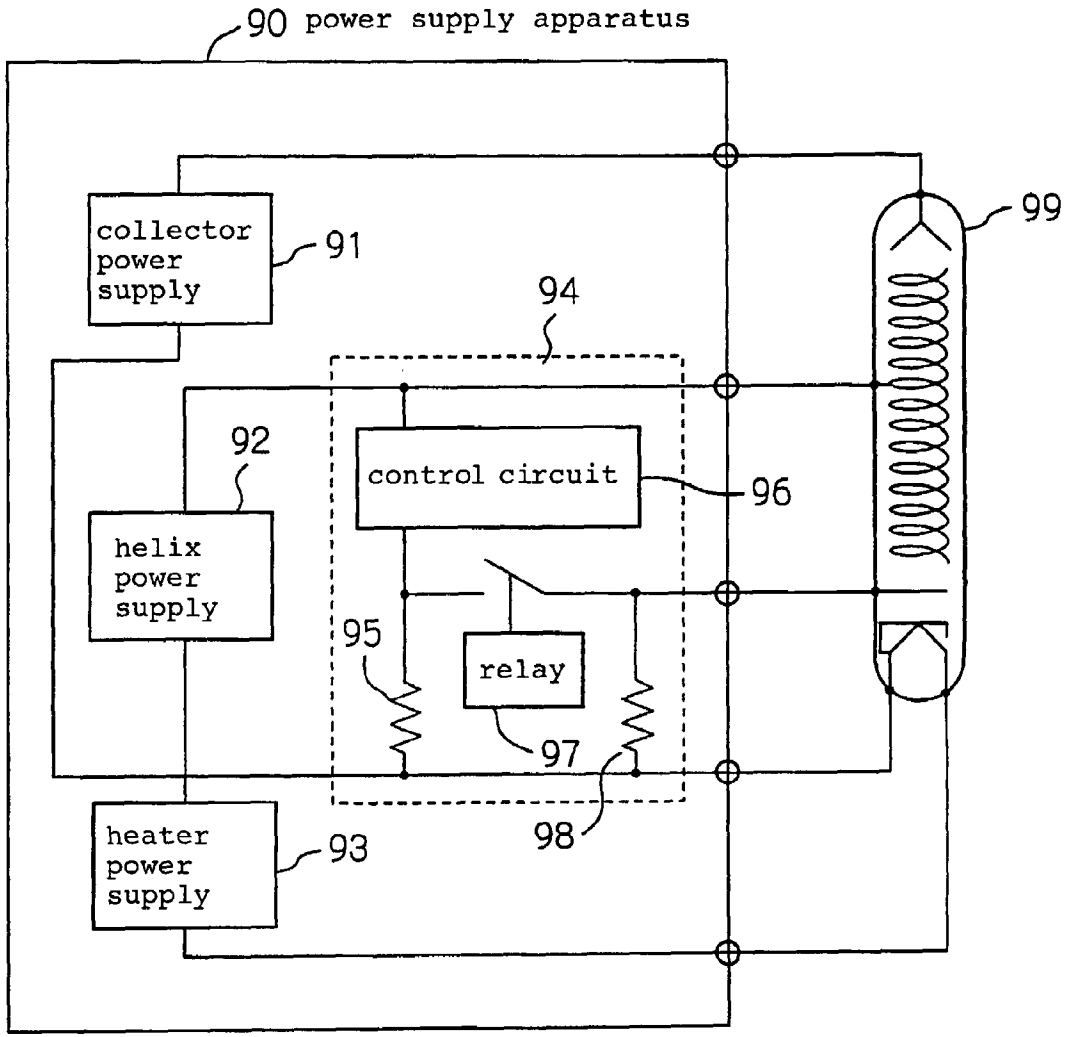
Fig. 1 (prior art)
FIG. 1 is a block diagram illustrating an exemplary configuration of a conventional power supply apparatus for a traveling-wave tube.
Figure 2:
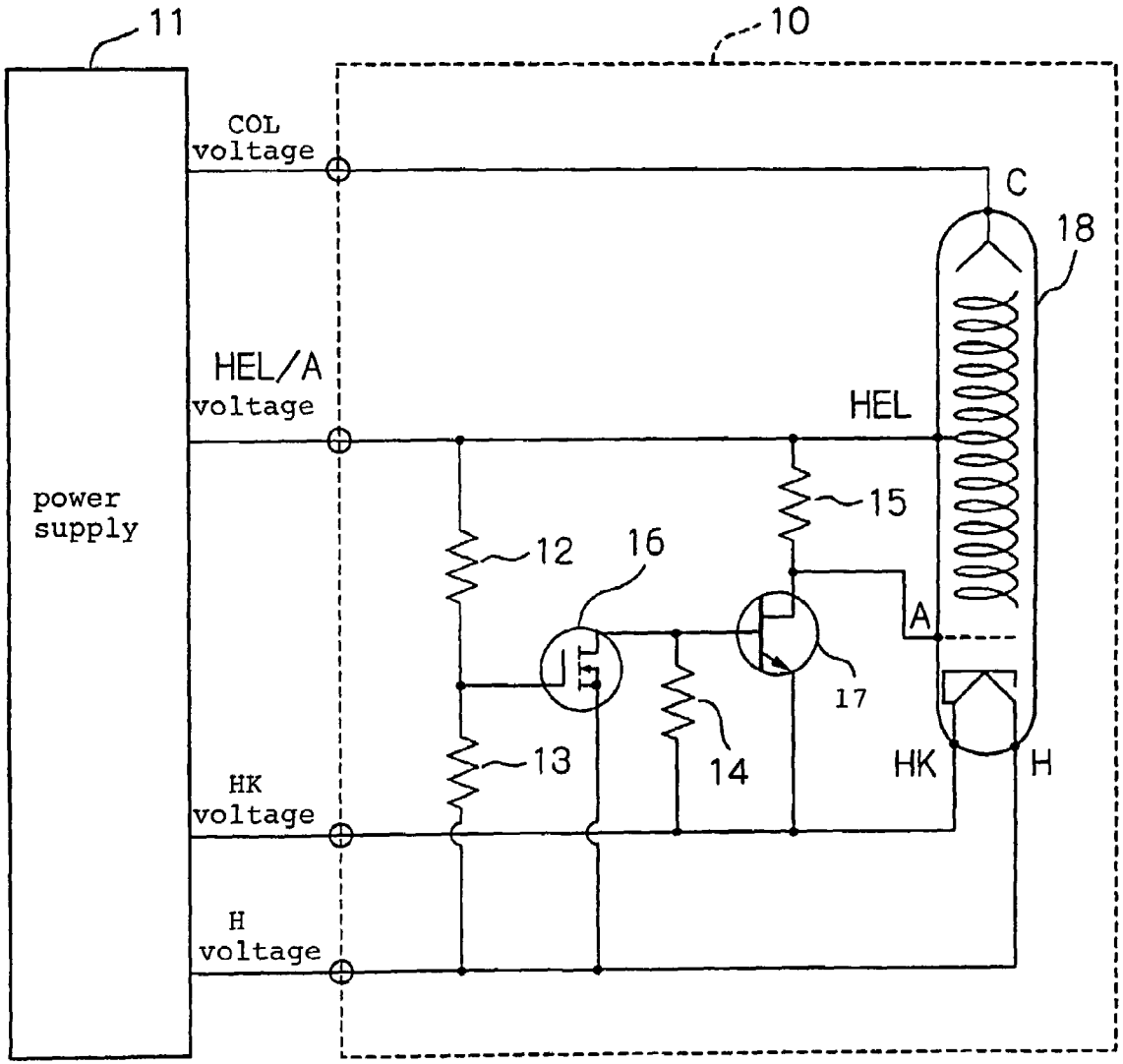
FIG. 2 is a block diagram illustrating a traveling-wave tube apparatus according to one embodiment of the present invention.

FIG. 2 is a block diagram illustrating a traveling-wave tube apparatus according to one embodiment of the present invention. Referring to FIG. 2, traveling-wave tube apparatus 10 of this embodiment comprises resistors 12–15, FETs 16, 17, and traveling-wave tube 18.

One electrode is commonly used as a heater electrode and a cathode electrode on the positive side of traveling-wave tube 18, so that this electrode is called the "heater/cathode electrode." Also, a heater electrode on the negative side of traveling-wave tube 18 is simply called the "heater electrode."

Traveling-wave tube apparatus 10 of this embodiment is supplied with a variety of voltages from power supply 11. Power supply 11, which is a high-voltage power supply for a traveling wave tube, supplies a collector voltage (COL voltage) to a collector electrode (C in the figure) of traveling-wave tube 18; a helix voltage (HEL/A voltage) to a helix electrode (HEL in the figure); a heater/cathode voltage (HK voltage) to the heater/cathode electrode (HK in the figure); and heater voltage (H voltage) to the heater electrode (H in the figure).

Resisters 12, 13 are connected in series between the helix electrode and heater electrode of traveling-wave tube 18. FET 16 has a gate connected to a junction of resistor 12 and resistor 13. FET 16 has a source connected to the heater electrode of traveling-wave tube 18. FET 16 has a drain connected to a gate of FET 17 and to one terminal of resistor 14. The source of FET 17 and the other terminal of resistor 14 are connected to the heater/cathode terminal of traveling-wave tube 18. FET 17 has a drain connected to one terminal of resistor 15 and to an anode electrode of traveling-wave tube 18. Resistor 15 has the other terminal connected to the helix electrode of traveling-wave tube 18.

FETs 16, 17, which are control devices made of semiconductor, each turn on and off the conduction between the two terminals, i.e., the drain and source, with the gate used as a control terminal. In this embodiment, FET 17 is a depletion FET of which gate can be controlled with a negative potential. The values of resistors 12, 13 are determined such that FET 16 turns on with a divided voltage generated by resistors 12, 13 when the helix voltage rises to approximately 90%. It should be noted that though FETs 16, 17 are each illustrated as a single device in FIG. 2, a plurality of FETs may be connected in series in order to provide a predetermined breakdown voltage.

Figure 3:
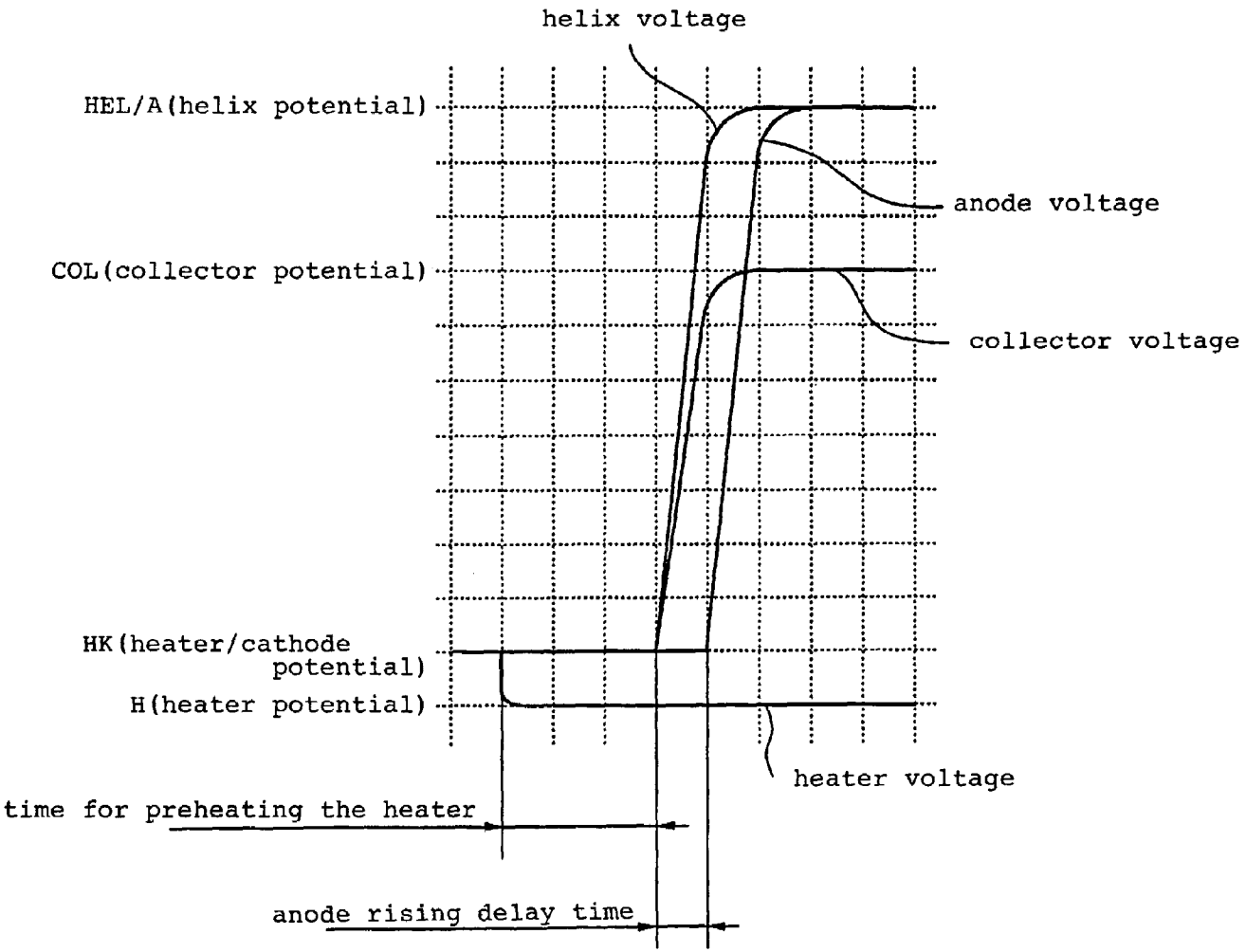
FIG. 3 is a timing chart representing the operation of the traveling-wave tube apparatus according to the embodiment.

FIG. 3 is a timing chart representing the operation of the traveling-wave tube apparatus according to this embodiment. While the operation of a traveling-wave tube is generally represented on the basis of the helix, FIG. 3 represents the operation on the basis of the heater/cathode voltage.

First, power supply 11 applies a heater voltage to the heater electrode. The heater potential is at several volts of negative polarity. After several minutes for preheating the heater, power supply 11 applies the helix voltage and collector voltage. The helix voltage and collector voltages are at several kilovolts. As the helix voltage rises to 90%, FET 16 which has so far remained off, turns on. An anode rising delay time is defined by a time from a point at which the helix voltage starts rising to a point at which the helix voltage rises to 90%. As FET 16 turns on, the potential at the gate of FET 17 becomes equal to the heater voltage, causing FET 17, which has so far remained on, to turn off. As FET 17 turns off, the anode voltage is applied to the anode electrode of traveling-wave tube 18. The anode voltage is at several kilovolts, substantially the same potential as the helix voltage. In this way, an anode sequence is ensured by the anode rising delay time.

As described above, while traveling-wave tube 18 is not applied with the helix voltage, FET 16 remains off, and depletion FET 17 is on with its gate and source held at the same potential. As the helix voltage is applied and rises to 90%, FET 16 turns on. As FET 16 turns on, the potential at the gate of FET 17 becomes lower than the potential at the source of FET 17, causing FET 17 to turn off to apply traveling-wave tube 18 with the anode voltage. With the foregoing configuration, the anode sequence can be realized only using voltages essentially needed by traveling-wave tube 18 without separately requiring a power supply such as a relay driving power supply, and by a circuit made up of semiconductor devices without using a large relay. Consequently, traveling-wave tube 18 can be powered in a small and low-cost configuration, and is tolerable to vibrations and impacts. Also, it should be particularly pointed out that since the anode sequence is achieved using the heater voltage which requires a low voltage stability, the operation of the traveling-wave tube becomes stable without affecting voltages to other electrodes which require the stability for realizing the anode sequence.

While the foregoing embodiment has illustrated an exemplary configuration of traveling-wave tube apparatus 10 which contains resistors 12–15 and FETs 16, 17, the present invention is not limited to this configuration. For example, FETs 16, 17 may be included in a power supply apparatus for a traveling-wave tube together with traveling-wave tube power supply 11. Alternatively, resistors 12–15 and FETs 16, 17 may not be included either in the traveling-wave tube apparatus or in the power supply apparatus but constitute an independent circuit apparatus.

Also, while the foregoing embodiment has shown an example in which the application of the anode voltage is started when the helix voltage rises to 90%, the present invention is not limited to this 90%, but only requires to ensure that the anode voltage is applied later than the helix voltage, and the voltage division ratio can be selected as long as the foregoing condition is satisfied.

Additionally, while the foregoing embodiment has shown an example in which resistors 12, 13 are connected in series between the helix electrode and heater electrode of traveling-wave tube 18, resistors 12, 13 may be connected in series between the helix electrode and heater/cathode electrode.

Further, while the foregoing embodiment has illustrated a configuration in which the heater electrode and cathode electrode share a single electrode on the positive side of traveling-wave tube 18, the present invention is not limited to this particular configuration. Alternatively, the heater electrode and cathode electrode may be independent of each other.

Further, while the foregoing embodiment has illustrated a configuration in which associated voltages are applied to the collector electrode, helix electrode, heater/cathode electrode, and heater electrode of traveling-wave tube 18 from single power supply 11, the present invention is not limited to the provision of a single power supply. Alternatively, the traveling-wave tube may have the cathode electrode and the heater electrode on the positive side independent of each other, wherein a power supply may be provided for applying voltages to the heater electrodes on the positive and negative sides, separately from a power supply for applying voltages to the remaining electrodes. Further alternatively, one power supply may be provided for each of the collector electrode, helix electrode, and cathode electrode.

Also, while the traveling-wave tube apparatus in the foregoing embodiment includes single FET 17, a plurality of FETs 17 may be connected in series when the helix voltage and anode voltage exceed a maximum drain-to-source rated voltage of FET 17.

FIG. 3 has illustrated that the helix voltage and anode voltage are at the same voltage. In case the anode voltage is lower than the helix voltage, resistor 15 may be replaced with two resistors proportional to the ratio of the helix voltage to the anode voltage, with a junction of the two resistors being connected to the anode electrode.

Figure 4:
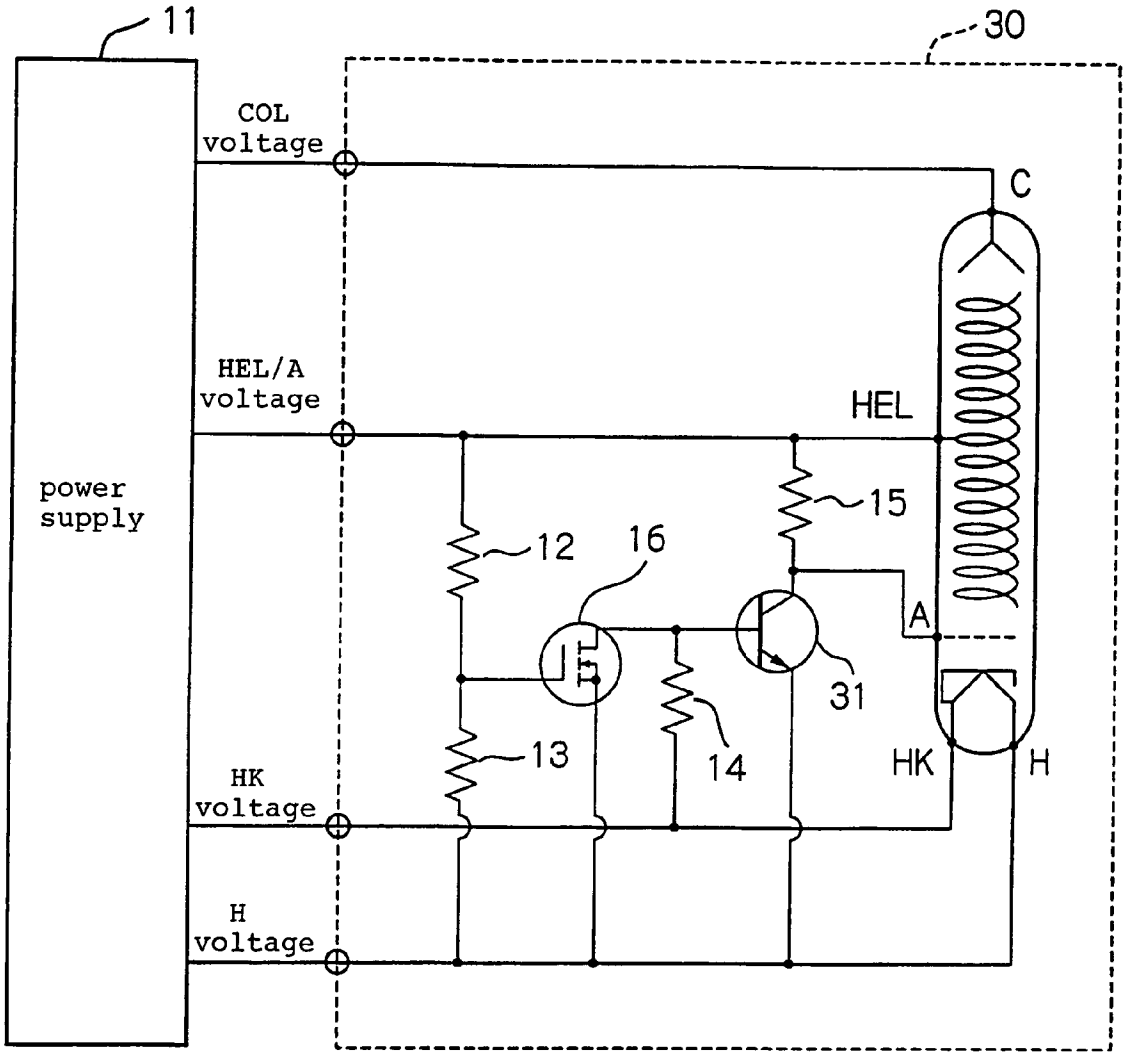
FIG. 4 is a block diagram illustrating a traveling-wave tube apparatus according to another embodiment of the present invention.

FIG. 4 is a block diagram illustrating a traveling-wave tube apparatus according to another embodiment of the present invention. Referring to FIG. 4, traveling-wave tube apparatus 30 of this embodiment comprises resistors 12–15, FETs 16, 31, and traveling-wave tube 18.

Similar to the embodiment illustrated in FIG. 2, power supply 11 supplies a collector voltage (COL voltage) to a collector electrode (C in the figure) of traveling-wave tube 18; a helix voltage (HEL/A voltage) to a helix electrode (HEL in the figure); a heater/cathode voltage (HK voltage) to a heater/cathode electrode (HK in the figure); and a heater voltage (H voltage) to a heater electrode (H in the figure).

Resistors 12, 13 are connected in series between the helix electrode and heater electrode of traveling-wave tube 18. FET 16 has a gate connected to a junction of resistor 12 and resistor 13. FET 16 has a source connected to the helix electrode of traveling-wave tube 18. FET 16 has a drain connected to a gate of FET 31 and to one terminal of resistor 14. The other terminal of resistor 14 is connected to the heater/cathode terminal of traveling-wave tube 18. FET 31 has a drain connected to one terminal of resistor 15 and to an anode electrode of traveling-wave tube 18. The other terminal of resistor 15 is connected to the helix electrode of traveling-wave tube 18. The connections so far described are the same as those in the embodiment illustrated in FIG. 2, except that FET 31 has a source connected to the heater electrode of traveling-wave tube 18. Also, the embodiment of FIG. 4 differs from that of FIG. 2 in that FET 31 is not a depletion FET but a general enhancement FET.

The values are determined for resistors 12, 13 such that FET 16 turns on with a divided voltage generated by resistors 12, 13 when the helix voltage rises to approximately 90%. Though FETs 16, 31 are each illustrated as a single device in FIG. 4, a plurality of FETs may be connected in series in order to provide a predetermined breakdown voltage.

The operation of the traveling-wave tube apparatus according to this embodiment is similar to that represented by FIG. 3.

First, power supply 11 applies a heater voltage to the heater electrode. The heater potential is at several volts of negative polarity. FET 31 turns on simultaneously when power supply 11 starts applying the heater/cathode voltage and heater voltage. After several minutes for preheating the heater, power supply 11 applies the helix voltage and collector voltage. The helix voltage and collector voltages are at several kilovolts. As the helix voltage rises to 90%, FET 16 which has so far remained off, turns on. An anode rising delay time is defined by a time from a point at which the helix voltage starts rising to a point at which the helix voltage rises to 90%. As FET 16 turns on, the potential at the gate of FET 31 becomes equal to the heater voltage, causing FET 31, which has so far remained on, to turn off. As FET 31 turns off, the anode voltage is applied to the anode electrode of traveling-wave tube 18. The anode voltage is at several kilovolts, substantially the same potential as the helix voltage. In this way, an anode sequence is ensured by the anode rising delay time.

As described above, when traveling-wave tube 18 is applied only with the heater voltage but not with the helix voltage, FET 16 turns off, and FET 31 turns on. As the helix voltage is applied and rises to 90%, FET 16 turns on, causing FET 31 to turn off because the potential at the gate of FET 31 becomes the same as that at the source of the same, to apply the anode voltage to traveling-wave tube 18. Thus, the anode sequence can also be realized in a manner similar to the configuration of FIG. 2 without using a depletion FET, only using voltages essentially needed by traveling-wave tube 18 without separately requiring a power supply such as a relay driving power supply, and by a circuit made up of semiconductor devices without using a large relay. Consequently, traveling-wave tube 18 can be powered in a small and low-cost configuration, and is tolerable to vibrations and impacts.

While the foregoing embodiment has employed an enhancement FET for FET 31, the present invention is not limited to the type of device employed for FET 31. For example, a bipolar transistor may be used instead of FET 31. In this case, the gate of FET 31 in FIG. 4 may be substituted with the base of the bipolar transistor; the drain of FET 31 with the collector of the bipolar transistor; and the source of FET 31 with the emitter of the bipolar transistor.

While preferred embodiments of the present invention have been described using specific terms, such description is for illustrative purpose only, and it is to be understood that changes and variations may be made without departing from the spirit or scope of the following claims.

What is claimed is:

1. A power supply circuit for a traveling-wave tube for applying a voltage to an anode electrode of the traveling-wave tube which is applied with different voltages from a power supply apparatus to a helix electrode, a positive heater electrode, a negative heater electrode, and a cathode electrode, said circuit comprising:

a first and second resistors connected in series between the helix electrode and the positive heater electrode or the negative heater electrode of said traveling-wave tube;

a first control device made of semiconductor and having a first terminal, a second terminal, and a first control terminal, said first terminal connected to the negative heater electrode, said first control terminal connected to a junction of the first resistor and the second resistor, said first control device turning on when a potential on the helix electrode rises to a predetermined threshold determined by the ratio of the first resistor to the second resistor with respect to a potential on the positive heater electrode or the negative heater electrode to conduct from the first terminal to the second terminal; and a second control device made of a semiconductor and having a third terminal, fourth terminal, and a second control terminal, said second control terminal connected to the second terminal of said first control device, said third terminal connected to the anode electrode of said traveling-wave tube, said fourth terminal connected to the positive heater electrode or the negative heater electrode, said second control device turning on when said first control device is off to maintain the anode electrode and the cathode electrode at the same potential, said second control device turning off when said first control device turns on to generate a potential difference between the anode electrode and the cathode electrode to apply a voltage to the anode electrode.

2. The power supply apparatus for a traveling-wave tube according to claim 1, wherein said second control device is a depletion FET, said second control terminal is a gate, said third terminal is a drain, and said fourth terminal is a source connected to the positive heater electrode.

3. The power supply apparatus for a traveling-wave tube according to claim 1, wherein said second control device is an enhancement FET, said second control terminal is a gate, said third terminal is a drain, and said fourth terminal is a source connected to the negative heater electrode.

4. The power supply apparatus for a traveling-wave tube according to claim 1, wherein said second control device is a bipolar transistor, said second control terminal is a base, said third terminal is a collector, and said fourth terminal is an emitter connected to the negative heater electrode.

5. A traveling-wave tube apparatus comprising:

a traveling-wave tube applied with different voltages from an external power supply to a helix electrode, a positive heater electrode, a negative heater electrode, and a cathode electrode;

a first and second resistors connected in series between the helix electrode and the positive heater electrode or the negative heater electrode of said traveling-wave tube;

a first control device made of semiconductor and having a first terminal, a second terminal, and a first control terminal, said first terminal connected to the negative heater electrode, said first control terminal connected to a junction of the first resistor and the second resistor, said first control device turning on when a potential on the helix electrode rises to a predetermined threshold determined by the ratio of the first resistor to the second resistor with respect to a potential on the positive heater electrode or the negative heater electrode to conduct from the first terminal to the second terminal; and a second control device made of a semiconductor and having a third terminal, fourth terminal, and a second control terminal, said second control terminal connected to the second terminal of said first control device, said third terminal connected to an anode electrode of said traveling-wave tube, said fourth terminal connected to the positive heater electrode or the negative heater electrode, said second control device turning on when said first control device is off to maintain the anode electrode and the cathode electrode at the same potential, said second control device turning off when said first control device turns on to generate a potential difference between the anode electrode and the cathode electrode to apply a voltage to the anode electrode.

6. The traveling-wave tube apparatus according to claim 5, wherein said second control device is a depletion FET, said second control terminal is a gate, said third terminal is a drain, and said fourth terminal is a source connected to the positive heater electrode.

7. The traveling-wave tube apparatus according to claim 5, wherein said second control device is an enhancement FET, said second control terminal is a gate, said third terminal is a drain, said fourth terminal is a source connected to the negative heater electrode.

8. The traveling-wave tube apparatus according to claim 5, wherein said second control device is a bipolar transistor, said second control terminal is a base, said third terminal is a collector, and said fourth terminal is an emitter connected to the negative heater electrode.

9. A power supply apparatus for a traveling-wave tube for applying different voltages to a helix electrode, a positive heater electrode, a negative heater electrode, a cathode electrode, and an anode electrode of the traveling-wave tube, said apparatus comprising:

a power supply for supplying different voltages to the helix electrode, the positive heater electrode, the negative heater electrode, and the cathode electrode of said traveling-wave tube;

a first and second resistors connected in series between the helix electrode and the positive heater electrode or the negative heater electrode of said traveling-wave tube;

a first control device made of semiconductor and having a first terminal, a second terminal, and a first control terminal, said first terminal connected to the negative heater electrode, said first control terminal connected to a junction of the first resistor and the second resistor, said first control device turning on when a potential on the helix electrode rises to a predetermined threshold determined by the ratio of the first resistor to the second resistor with respect to a potential on the positive heater electrode or the negative heater electrode to conduct from the first terminal to the second terminal; and a second control device made of a semiconductor and having a third terminal, fourth terminal, and a second control terminal, said second control terminal connected to the second terminal of said first control device, said third terminal connected to the anode electrode of said traveling-wave tube, said fourth terminal connected to the positive heater electrode or the negative heater electrode, said second control device turning on when said first control device is off to maintain the anode electrode and the cathode electrode at the same potential, said second control device turning off when said first control device turns on to generate a potential difference between the anode electrode and the cathode electrode to apply a voltage to the anode electrode.

10. The power supply apparatus for a traveling-wave tube according to claim 9, wherein said second control device is a depletion FET, said second control terminal is a gate, said third terminal is a drain, and said fourth terminal is a source connected to the positive heater electrode.

11. The power supply apparatus for a traveling-wave tube according to claim 9, wherein said second control device is an enhancement FET, said second control terminal is a gate, said third terminal is a drain, said fourth terminal is a source connected to the negative heater electrode.

12. The power supply apparatus for a traveling-wave tube according to claim 9, wherein said second control device is a bipolar transistor, said second control terminal is a base, said third terminal is a collector, and said fourth terminal is an emitter connected to the negative heater electrode.

* * * * *